US005851080A

United States Patent [19]

Nakajima et al.

[11] Patent Number: 5,851,080

[45] Date of Patent: Dec. 22, 1998

[54] CARTRIDGE-TYPE LIQUID APPLICATOR

[75] Inventors: Nobuyuki Nakajima, Takasaki; Toru Nagai, Tamamura-machi, both of Japan

[73] Assignee: Mitsubishi Pencil Co., Ltd., Tokyo, Japan

[21] Appl. No.: 714,522

[22] Filed: Sep. 16, 1996

Related U.S. Application Data

[63] Continuation-in-part of Ser. No. 555,140, Nov. 8, 1995, abandoned.

[30] Foreign Application Priority Data

Nov. 21, 1994 [JP] Japan ..... 6-312792

[51] Int. Cl.[6] ..... A46B 11/04

[52] U.S. Cl. ..... 401/279; 401/86; 401/192; 401/194; 401/272; 401/273

[58] Field of Search ..... 401/272, 273, 401/278, 279, 86, 192, 194

[56] References Cited

U.S. PATENT DOCUMENTS

| | | | |
|---|---|---|---|
| 1,412,930 | 4/1922 | Friedman | 401/192 X |
| 2,078,083 | 4/1937 | Larsen | 401/192 |
| 4,240,759 | 12/1980 | Matsumoto, et al. | 401/86 |
| 5,137,388 | 8/1992 | Kimura | 401/278 |

FOREIGN PATENT DOCUMENTS

| | | |
|---|---|---|
| 1-99475 | 7/1989 | Japan . |
| 2-91681 | 7/1990 | Japan . |
| 5-68684 | 9/1993 | Japan . |

*Primary Examiner*—Steven A. Bratlie
*Attorney, Agent, or Firm*—Armstrong, Westerman, Hattori, McLeland & Naughton

[57] ABSTRACT

A liquid applicator is provided which is capable of using a cartridge-type tank. The liquid applicator has a lock mechanism which is capable of preventing an inadvertent pressing of the knocking rod with a simple construction. A cartridge-type tank containing a liquid therein is accommodated within the cylindrical applicator body while a soaker for applying the liquid sealed in the tank is attached to the forward tip end of the applicator body. The cylindrical tail plug is detachably fitted into the rearward end of the applicator body with the tail plug being formed with an engaging lug radially outwardly therein. The knocking rod is coaxially provided inside the cylindrical tail plug with the lug inwardly projecting from an inside surface of the tail plug being engaged with the L-shaped groove formed in the periphery of the knocking rod.

5 Claims, 9 Drawing Sheets

CARTRIDGE-TYPE LIQUID APPLICATOR

This application is a continuation-in-part of application Ser. No. 08/555,140 filed Nov. 8, 1995, now abandoned.

BACKGROUND OF THE INVENTION

The present invention relates to an applicator which applies liquids sealed in a cartridge-type tank, including writing ink, mending liquid, chemical lotion, paint, adhesive, liquid chemicals, liquid shoe cream, etc.

In the prior art liquid applicator of this type, those as shown in FIGS. 10 through 12 were proposed. The applicator of FIG. 10 is an embodiment of the invention for which an application for patent was filed (under U.M. Appln. Kokai Pub. No. 2-91681) by the instant applicant, where the reservoir tank 60 is accommodated in the cylindrical applicator body 50, with the tip end of the applicator body 50 being attached to the brush-like soaker body 51 for applying the liquid sealed in the tank 60.

The tail plug 70 is fitted or attached by adhesive to the rearward end of the applicator body 50. Further, the cylindrical knocking rod 80 has a closed end and is slidably attached to the tail plug 70. A loaded coil spring 90 is between the closed end of the knocking rod 80 and the tail end of the reservoir tank 60 to urge the knocking rod 80 rearwardly.

The liquid applicator shown in FIG. 11 is disclosed in an earlier application filed again by the instant applicant (under U.M. Appln. Kokai Pub. No. 1-99475). The structure shown in FIG. 11 is provided with an additional structure, especially such as a lock mechanism added to the knocking rod 80.

In other words, the knocking rod 80 is formed with an L-shaped groove 81 extending axially and circumferentially, while the applicator body 50 is formed with a lug 51 which is to be admitted into a groove 81.

Normally, the knocking rod 80 takes a position so as to extend rearwardly of the applicator body 50, as shown in the figure, under the compression of a spring (not shown) which is loaded inside the knocking rod 80. When the lug 51, which is formed in the applicator body 50, is rotated into and along the circumferential groove 81*a* formed in the knocking rod 80, the knocking rod 80 is brought into a locked condition (i.e. it is impossible to knock).

In an axial end surface of the groove 81a, formed circumferentially in the knocking rod 80, a lug 81*b* is formed. The lug 51 formed in the applicator body 50 is adapted to override so that a clicking sound is given to the knocking rod 80 at the time of the locking operation.

Further, the prior art liquid applicator shown in FIG. 12 is again an embodiment of an invention with respect to which the instant applicant filed an application therefor (under U.M. Appln. Kokai Pub. 5-68684) and wherein the tank, which contains the liquid, is a cartridge-type displaceable one.

In other words, the cartridge-type tank 60, which has the liquid sealed therewithin, is accommodated in the cylindrical liquid applicator body 50. A brush-like soaker 51 is attached to the tip end of the cylindrical liquid applicator body 50 for the application of the liquid sealed in the tank 60.

Further, the detachable cylindrical tail plug 70 is fitted into the rear end of the applicator body 50 with the cartridge-type tank 60 being inserted thereinto.

In the cartridge-type tank 60, a shouldered portion 61 is formed so as to face rearwardly of the tank 60. The shouldered portion 61, formed in the tank 60, is adapted to engage the forward end 71 of the tail plug 70.

Therefore, the cartridge-type tank 60 is arranged so as to be replaceable, when the tail plug 70 is removed from the applicator body 50.

The cartridge-type tank 60, accommodated within the applicator body 50, is exposed through the opening 70*a* which is formed in the rearward end of the tail plug 60 such that direct pressing by a finger of the exposed end of the tank 60 causes an optimum amount of the liquid sealed in the tank 60 to be forced out to the brush-like soaker 51.

In the prior art liquid applicator shown in FIG. 10, the knocking rod 80 is urged to protrude rearwardly of the applicator body 50 under the influence of expansion of the coil spring 90 loaded between the knocking rod 80 and the reservoir tank 60 in the cylindrical applicator body 50.

Due to the presence of the expansion of the coil spring 90, the cylindrical tail plug 70, for retaining the knocking rod 80, is required to be attached firmly to some extent to the applicator body 50 by being press fit or fixed by adhesive, with the result that it is impossible to use the tank 60 for a readily replaceable cartridge-type one.

Further, the example shown in FIG. 10 still allows a technical problem, such as staining clothes or similar, to remain unsolved since inadvertent pressing of the knocking rod 80 can result in the oversupply of the liquid sealed in the reservoir tank 60 to the brush-like soaker 51.

Further, the prior art liquid applicator, shown in FIG. 11, is provided with a lock mechanism in the knocking rod 80 by means of a combination of the lug 51, formed in the applicator body 50, and the L-shaped groove 81, formed in the knocking rod 80, such that the above-mentioned problem of the oversupply of the liquid sealed in the reservoir tank 60 caused by any inadvertent pressing of the knocking rod 80 has been solved.

However, it is impossible to adopt a cartridge-type readily replaceable tank in this structure due to the structure in which a coil spring is used as shown in FIG. 10.

Further, although the structure gives a clicking sound to the knocking rod 80, the lug 81*b*, which is formed to give the clicking sound, is provided in the axial end surface of the groove 81*a* which is formed circumferentially. This means that the clicking sound is given only under the influence of the expansion of the coil spring 90.

Therefore, the use of a coil spring required in this type of liquid applicator not only makes the structure complicated, but the clicking sound is not given if an attempt is made to lock the knocking rod 80 while pressing, thus allowing the technical problem of unreliable sound remains unsolved.

The prior art liquid applicator shown in FIG. 12 eliminates the need for a coil spring 90 as mentioned in the foregoing, thus making the structure simplified. Further, it is possible to use a detachable cylindrical plug 70 to be attached to the applicator body 50 since no coil spring 90 is incorporated thereinto. Thus, a replaceable cartridge-type tank 60 can be used. However, other technical problems still remain unsolved for reasons such as the likelihood of inadvertent pressing of the tail end of tank 60 and the likelihood of missing the user's hold with the result that the liquid in the tank 60 is oversupplied to the brush-like soaker body 51 to stain the user's clothes.

SUMMARY OF THE INVENTION

The present invention is made to solve the aforementioned problems with the prior art and it is an object of the present invention to provide a cartridge-type liquid applicator, which enables the incorporation of a cartridge-type tank, and a lock mechanism to prevent any inadvertent pressing of the knocking rod by means of a simple structure, while giving a distinct clicking sound at the time of locking.

In order to accomplish the aforementioned problems, the liquid applicator of the present invention provides means comprised of a cylindrical applicator body having an inside surface and accommodating therewithin a cartridge-type tank sealed with a liquid therewithin and a soaker body attached to the cylindrical applicator body at a forward end thereof for applying the liquid sealed in the tank, the cartridge-type liquid applicator comprising a cylindrical tail plug detachably fitted to the applicator body at a rearward end thereof and having an engaging lug formed to extend inwardly from the inside surface; a knocking rod arranged within the cylindrical tail plug and formed in the periphery there-of with a L-shaped groove having circumferential section and an axial section engageable with the engaging lug for permitting a circumferential slide and an axial pressing action thereof to realize a locking of the tail plug as well as a forcing of the tank accommodated within the applicator body forwardly there-through.

Further, it is preferable that first engagement means be formed in a periphery of the cylindrical tail plug while second engagement means be formed in an inside surface of the applicator body at a portion thereof which contacts the tail plug. The tail plug is formed with slits parallel to an axis thereof.

It is also preferable that a protuberance is formed in the circumferential section of the L-shaped groove at an area where the circumferential section adjoins the axial section thereof. In this case, it is also possible to provide a second protuberance protruding radially outwardly at an intermediate area of the circumferential groove.

Further, it is preferable to form a window in the periphery of the knocking rod at an area clear of the L-shaped groove to allow inspection of the cartridge-type tank accommodated in the applicator body.

In the aforementioned cartridge-type liquid applicator, a cylindrical tail plug is detachably fitted to the rearward end of the applicator body with an engaging lug, formed in the tail plug, engageable with the L-shaped groove, with the result that a locking mechanism is obtained to block the axial and forward advance of the knocking rod.

Further, first engagement means are formed in the outer periphery of the tail plug while second engagement means are formed in the inside surface at a portion of the applicator body which contacts the tail plug, with slits being formed to extend parallel with an axis of the cylindrical tail plug such that a mechanical elasticity is given at the engaging lug and recess sections of both members.

Further, a radially outwardly extending overridable protuberance is formed in the area where the circumferential section and the axial section of the L-shaped groove, formed in the outer periphery of the knocking rod, join each other such that a click mechanism is provided for the locking operation of the knocking rod.

Further, the provision of a window in the periphery of the knocking rod enables the inspection of the cartridge-type tank accommodated in the applicator body therethrough. Further, the window is preferably formed with a connecting piece to prevent the cartridge-type tank, facing the window, from being pressed.

DETAILED EXPLANATION OF EMBODIMENTS

Hereinafter, a hair-dye, in the form of a cartridge-type liquid applicator as an embodiment of the present invention, will be explained with reference to FIGS. 1 through 9.

Figure 1:
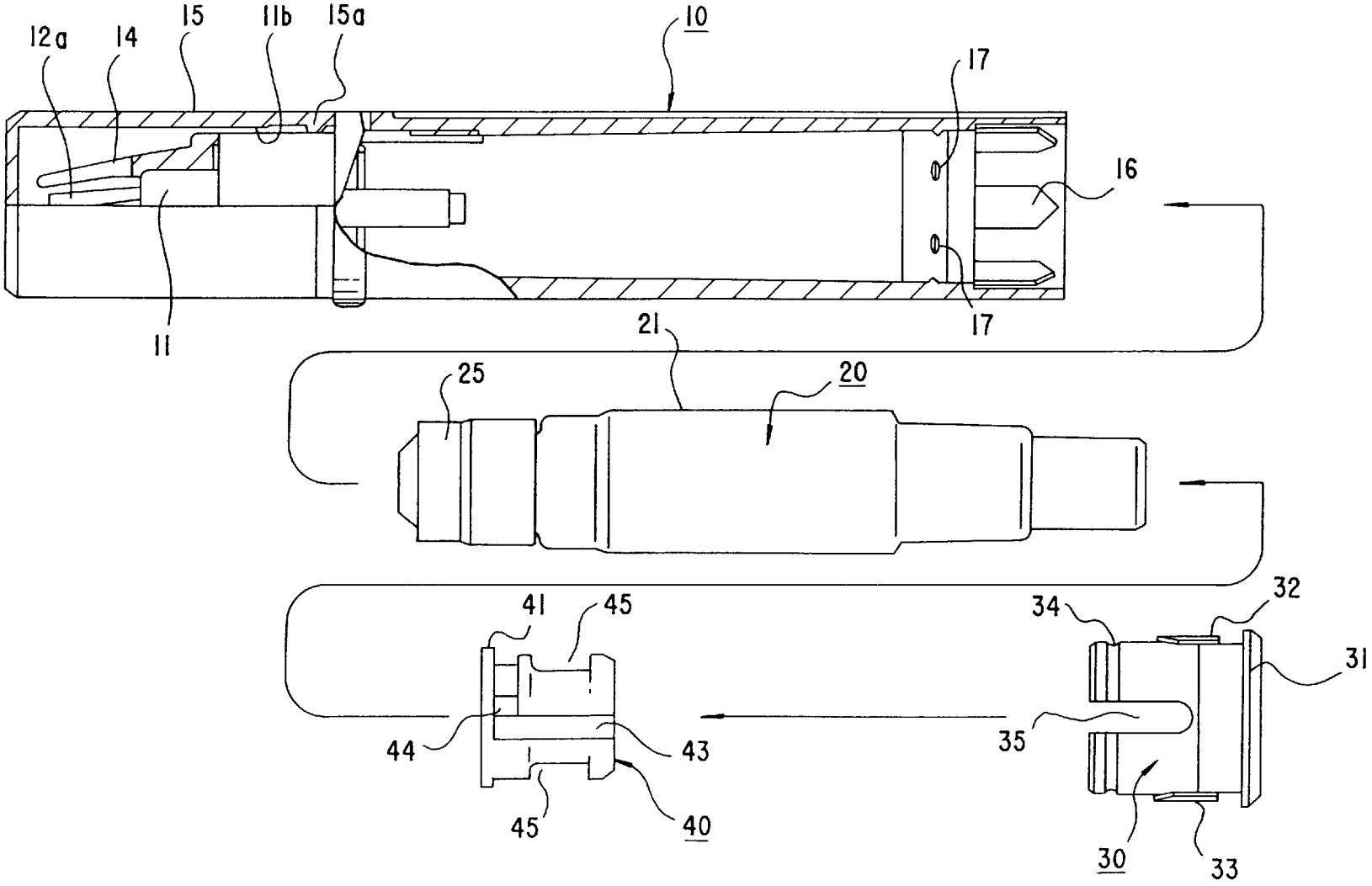
FIG. 1 is a partially broken cross-sectional view showing the cartridge-type liquid applicator of the present invention with components being shown in a disassembled state.
Figure 2:
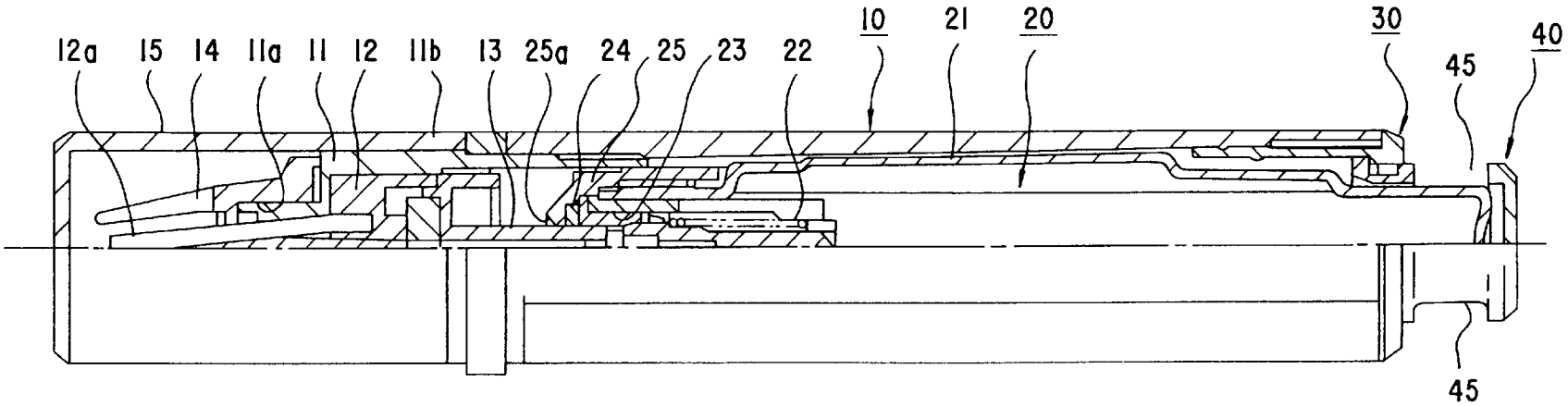
FIG. 2 is a partially broken longitudinal cross-sectional view showing the embodiment of FIG. 1 with components being shown in an assembled state.

First, FIG. 1 is a partially broken cross-section of components in a disassembled state, while FIG. 2 is a longitudinal partial cross-section thereof in an assembled state.

In FIGS. 1 and 2, the liquid applicator of this embodiment is composed of the applicator body 10, the cartridge-type tank 20, the tail plug 30 and the knocking rod 40.

The applicator body 10 is formed of synthetic resin material in a cylindrical shape with the rearward end thereof being open, while an inside surface of the forward end thereof is screwed into a cylindrical forward shaft 11.

A pedestal 12 is arranged in the inside periphery of the cylindrical forward shaft 11. A brush 12*a* is implanted into the pedestal 12 to extend forwardly as a soaker for application work of the liquid (hair dye) sealed in the tank 20. The brush 12*a* is formed to converge such that the tip end thereof gets slightly closer to the center axis thereof. Further, the pipe 13 for supplying the liquid to the brush 12*a* is secured to the center of the forward shaft 11 to extend rearwardly within the applicator body 10 at a forward portion thereof.

A plastic comb member is attached around the forward periphery 11*a* of the forward shaft 11. The forward tip end of the plastic comb member 14 is formed to slope slightly closer to the axis thereof and extend so as to be substantially parallel to the brush 12*a*.

The cap 15 of a closed end cylinder is detachably fitted to the forward shaft 11 at a portion close to the body 10, while the continuous seal lug 15*a* within the cap 15 of the closed end cylinder is provided to hermetically contact the forward shaft 11 at an area close to the body 10 for a sealing purpose.

A plurality of guides lugs 16 are formed in the inside surface of the rearward opening of applicator body 10. The guide lugs 16 are arrow-shaped having a point of a predetermined angle. The guide lugs 16 are arranged at regular intervals in a circumferential direction. Small lugs, in a broken annular shape, are arranged forwardly of said guide lugs.

On the other hand, the tank body 21 of the cartridge-type tank 20 is made of semitransparent synthetic material to seal the liquid (hair dye) therein. The forward opening of the tank body 21 accommodates the valve body 23 which is urged by the coil spring 22 in a seal direction. The valve body 23 is screwed into the forward opening of the tank body 21 by way of an annular rubber sealant 24 to be retained by the cap 25 having a supply opening 25a for receiving the pipe 13 centrally thereinto.

Figure 3A:
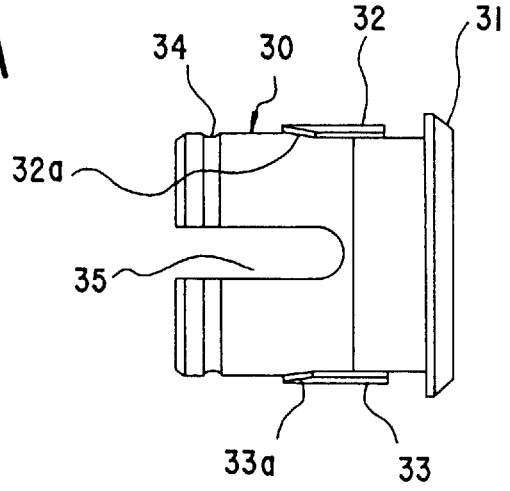
FIG. 3*a*–3*c* are outside views of the tail plug shown in FIG. 1.
Figure 3B:
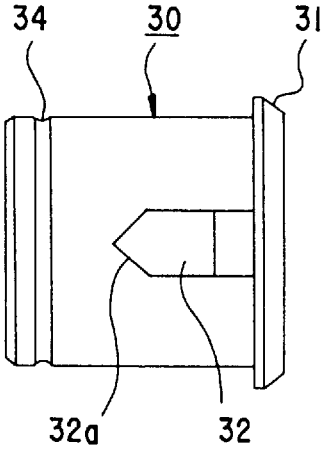
Figure 3C:
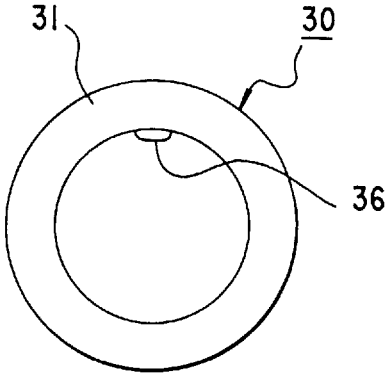
Figure 4A:
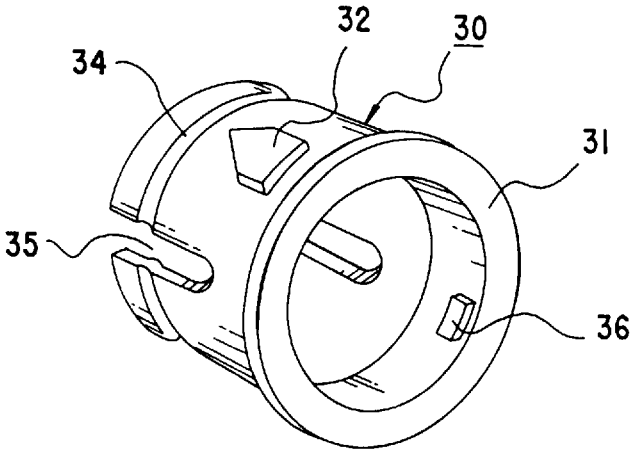
FIG. 4*a* and 4*b* are a perspective view and a centrally cut cross-sectional view, respectively of the tail plug of FIG. 3*a*–3*c;*
Figure 4B:
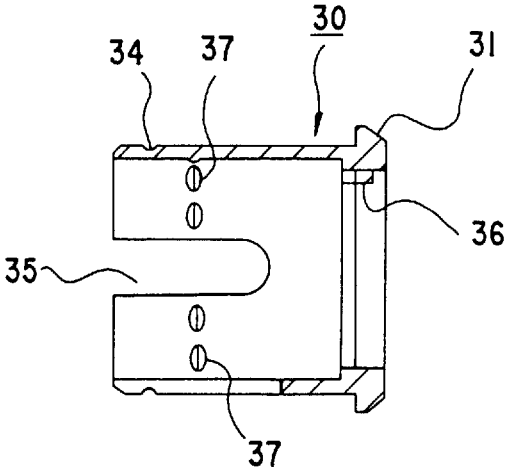

Next, the tail plug 30 is shown in FIG. 3*a* which is a front view thereof, in FIG. 3*b* which is a rear view thereof, and in FIG. 3*c* which is a right side elevational view thereof. The tail plug 30 is made of a synthetic material generally in cylindrical form as shown in FIG. 4*a*, which is a perspective view thereof, and in FIG. 4*b*, which is a centrally cut cross-sectional view thereof.

The outside diameter of the tail plug 30 is sized to allow insertion thereof into the rear end opening of the applicator body 10, with a slight friction therebetween, and with flange portion 31 being integrally formed in the open rear end portion of the tail plug 30. The flange portion 31 is designed to abut against the rear end portion of the applicator body 10 when engaged therewith.

In the periphery of tail plug 30, pentagonal guides 32 and 33 are formed on 180 degrees opposite sides. The pentagonal guides 32 and 33 have pointed portions 32*a* and 33*a*, respectively, which are forwardly directed. In the periphery of the tail plug 30, a circular groove 34 is formed close to and along the forward end thereof. Further, a pair of slits 35 are formed at 90 degree, at circumferentially spaced apart intervals in the tail plug 30. The pair of slits 35 extend parallel to the axis f the tail plug 30 from the forward end to the intermediate portion thereof.

A engaging lug 36 is formed in the vicinity of the rearward open end at an inside surface of tail plug 30. Small lugs 37 are formed in the inside surface of the tail plug 30 at an area in broken annular form slightly closer to the forward end thereof.

Figure 5:
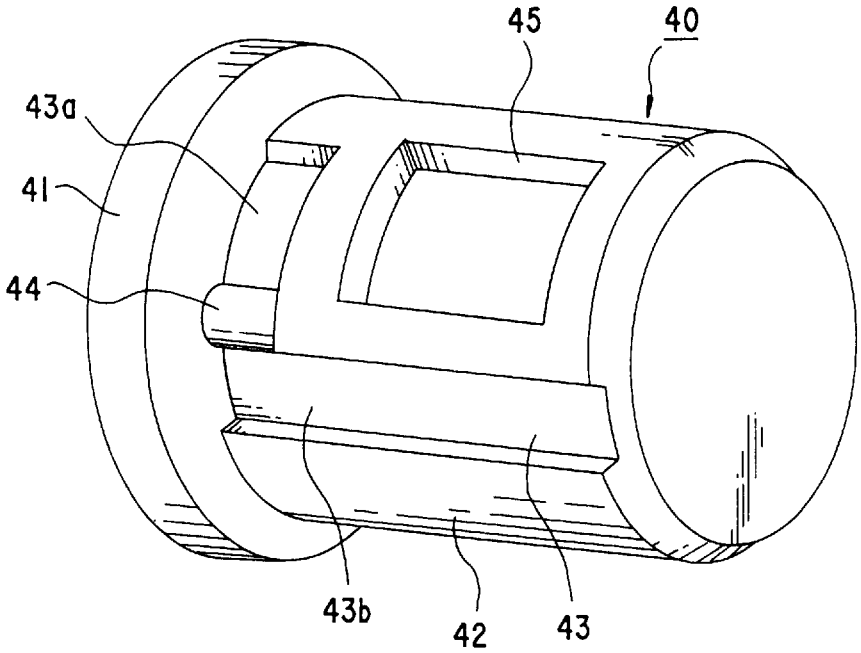
FIG. 5 is an enlarged perspective view of the knocking rod shown in FIG. 1.
Figure 6:
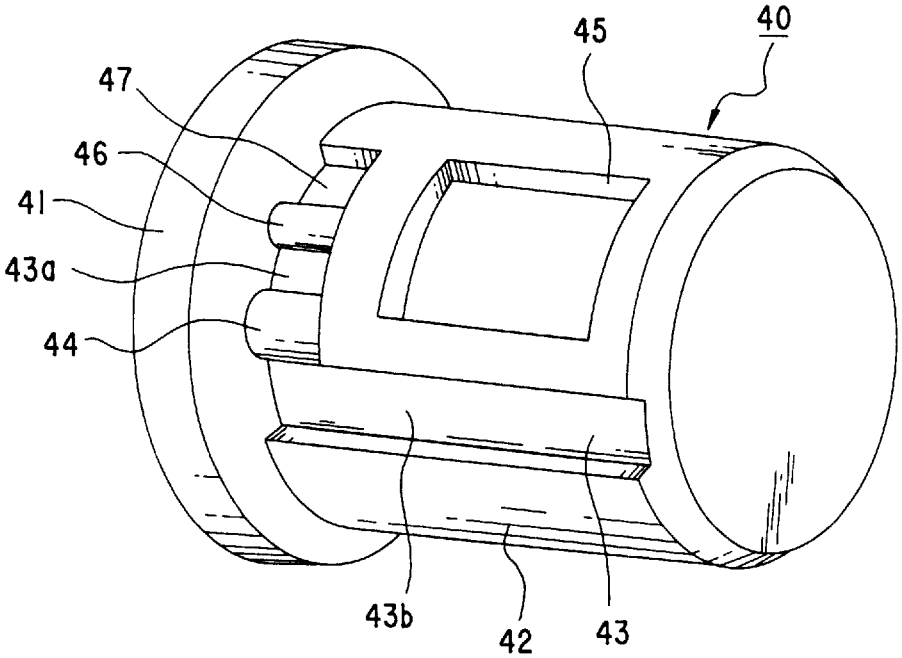
FIG. 6 is a perspective view of a modification of the knocking rod.

Next, the knocking rod 40 is of a synthetic resin material and is formed, as shown in perspective view in FIGS. 5 and 6, in a closed end cylindrical shape with the open end thereof being formed with a flange 41. The diameter of the flange 41 is sized slightly smaller than the inside diameter of the tail plug 30, while the outside diameter of cylindrical main body portion 42 is sized slightly smaller than the inside diameter of the rearward portion of the tail plug 30.

An L-shaped groove 43 is formed in the periphery of the cylindrical main body portion 42. The L-shaped groove 43 is composed of a circumferential section 43*a* and an axial section 43*b*. Thus, the L-shaped groove 43 permits a circumferential slide of the knocking rod 40 as well as an axial pressing of the knocking rod 40 in relation to the tail plug 30. The protuberance 44 of an overridable configuration is formed in the circumferential section 43*a* of the L-shaped groove 43 to project radially outwardly at an area where the circumferential section 43*a* adjoins axial section 43*b*. A pair of rectangular windows 45 are formed clear of the L-shaped groove 43 in the periphery of the knocking rod 40 on opposite sides which are 180 degrees apart.

The pair of rectangular windows 45 are, as will be described later, aimed at assuring the visual inspection of the reading for the remaining volume of the liquid inside the tank 20. Moreover, it is possible to remove the tail plug 30 from the body 10 by touching a rectangular window 45 by a finger to pull the knocking rod 40 at the time of replacement of the cartridge tank 20.

However, the finger of the operator can press the flank of the cartridge tank 20 through the rectangular window 45. If the operator tries to pull out the knocking rod 40 with the tank 20 being pressed, any residual liquid in the tank 20 can splash around.

Figure 7:
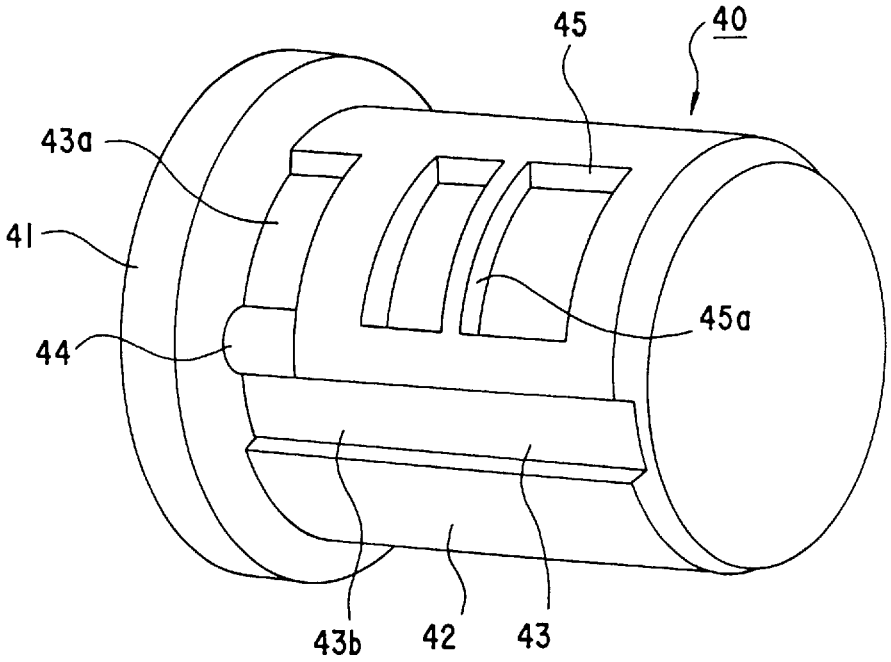
FIG. 7 is a perspective view of a modification of the embodiment of FIG. 5 in which a connecting piece is formed in the window of the knocking rod.
Figure 8:
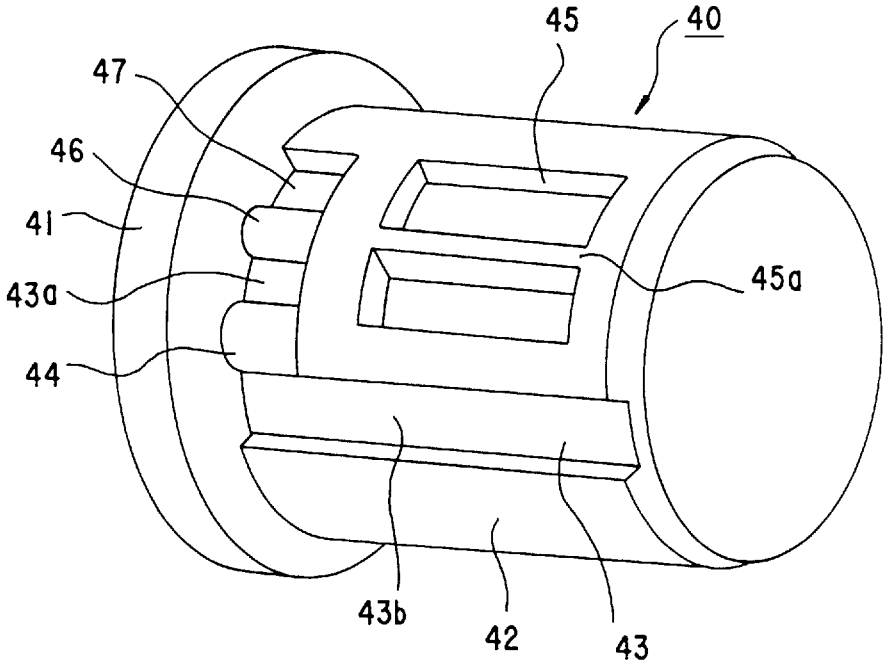
FIG. 8 is a perspective view of a modification of the embodiment of FIG. 6 in which a connecting piece is formed in the window of the knocking rod.

In order to prevent such splashing, a connecting piece 45*a* is formed across each window 45, as shown in FIGS. 7 and 8.

FIG. 7 shows that the connecting piece 45*a* is formed to extend in the circumferential direction of the knocking rod 40 whereas FIG. 8 shows that the connecting piece 45*a* is formed to extend in the axial direction of the knocking rod 40.

From these figures, it is clear that the arrangement of the connecting piece 45*a* in FIG. 7 is easier to manipulate by a finger for replacement work than the arrangement of the connecting piece 45*a* in FIG. 8, because the finger obtains better engagement over the window 45.

The closed end of the thus constructed knocking rod 40 is inserted into the open end of tail plug 30, as shown in FIG. 1, with the engaging lug 36 formed in the inside surface of the tail plug 30 which is engaged with the axial section 43*b* of the L-shaped groove 43 formed in knocking rod 40. When the knocking rod 40 is somewhat firmly forced into the tail plug 30, the flange 41 of the knocking rod 40 overrides the small lugs 37 arranged in a broken annular fashion in the inside surface of the tail plug 30 such that the knocking rod 40 is fitted in the tail plug 30.

Further, the cartridge tank 20 is inserted into the applicator body 10 before the forward end of the tail plug 30, with the knocking rod 40 being fitted therein, is forced into the rearward opening of the applicator opening 10, while the guides 32 and 33 formed in the periphery of the tail plug 30 steer clear of the guides 16 formed in the inner faces of the rearward openings of the applicator body 10. When the flange 31, formed in the tail plug 30, abuts against the rearward rim of the applicator body, lugs 17 formed in the inside surface of applicator body 10 are nested in circular recess 34 formed in the periphery of tail plug 30 to complete the assemblage of the liquid applicator.

At this time, the slits 35, formed in tail plug 30, prove elasticity thereto to assure a relatively smooth fitting operation of the applicator body 10.

When the applicator body 10 is thus assembled, a forward pressing of the knocking rod 40 causes the knocking rod 40 to press the rearward end of the tank 20, thereby advancing the tank 20 forwardly within applicator body 10.

In this case, the pipe 13, which is centrally disposed in the applicator body 10, presses the valve body 23 in the tank 20 against the urging force of the coil spring 22 to admit the liquid via the opened valve body 23 through the pile 13 and finally to the brush 12*a*.

When the forward pressing of the knocking rod 40 is stopped, the valve body 23 pushes the pipe 13 up by the expansion of the coil spring 22 in the tank 10, to cause the tank 20 to regress in response thereto within the applicator body 10. At this time, the valve body 23 is closed while the regress of the tank 20 causes the knocking rod 40 to project rearwardly of the applicator body 10 to the original position.

After the use of the applicator, the knocking rod 40 is turned counterclockwise in facing relation to the applicator body 10 until the engaging lug 36 in the tail plug 30, which is engaged with the L-shaped groove 43 in the knocking rod 40, slightly abuts against the protuberance 44 of the overridable configuration projecting radially outwardly from the circumferential section 43*a* of the groove 43. If, under the circumstance, the knocking rod 40 is further turned counterclockwise, both the tail plug 30 and the knocking rod 40 are slightly deformed to help the engaging lug 36 override the protuberance 44 into the circumferential section 43*a* of the groove 43. At the time of the engaging lug 36 overriding the protuberance 44, an optimum clicking sound is given.

Even if the knocking rod 40 is pressed forwardly with the engaging lug 36 formed in the tail plug 30 being engaged with the circumferential section 43*a* formed in the knocking rod 40 as detailed in the foregoing, the engaging lug 36 in the tail plug 30 abuts against the circumferential section 43*a* formed in the knocking rod 40 to lock the knocking rod 40 such that the forward pressing thereof is prevented.

Further, a pair of rectangular windows 45 are formed in the periphery of the knocking rod 40 on opposite sides 180 degrees apart such that the cartridge-type tank 20, made of semitransparent synthetic resin, is viewed through the windows 45 to allow an inspection of the reading for the remaining liquid volume in the tank 20.

To replace the tank 20, the knocking rod 40 is gripped and jerked rearwardly of the applicator body 10 with a suitable force, such that the flange 41 of the tail plug 30 is pulled rearwardly, with the result that the lugs 17, formed in the inside surface of the applicator body 10, escape from the circular groove 34 formed in the periphery of the tail plug 30. thus assuring an easy removal of the tail plug 30 together with the knocking rod 40 from the applicator body 10.

At this time, the rectangular windows 45 in FIGS. 7 and 8 are formed with the connecting pieces 45*a* thereacross, to make sure that the finger which has landed on the rectangular window 45, will not be pressed against the flank of the cartridge tank 20, thus eliminating the possibility of the residual liquid in the cartridge tank 20 being splashed around even if the knocking rod 40 is pulled out.

In this way, the cartridge tank 20 is replaced with a new one before the tail plug 40 is attached to the applicator body 10 by following a procedure similar to the foregoing to complete the assemblage of the applicator tank 10.

Although the embodiment in the figures shows that the circular groove 34 is formed in the periphery of the tail plug 30, whereas the engaging lugs 17, which are to engage the grooves 34, are arranged in a broken annular form around the inside surface of the applicator body 10, it is also possible to obtain a similar effect by forming lugs in the periphery around the tail plug 30 and a corresponding recess in the inside surface of the applicator body 10.

FIG. 6 shows a modified form of the knocking rod 40, in which similar portions are shown by the same numerals, an explanation of which will be omitted.

In FIG. 6, the first protuberance 44 projects radially outwardly, as in FIG. 5, from the circumferential section 43*a*, at an area where the circumferential section 43*a*, formed in the periphery of the knocking rod 40, adjoins axial section 43*b* formed in the knocking rod 40. Further, the second protuberance 46, which projects radially outwardly, is formed substantially in the intermediate area in the circumferential section 43*a* of the L-shaped groove 43 of the knocking rod 40.

In this modification, two clicking sounds are given at the time of locking the knocking rod 40 to provide sensory recognition of the lock.

Further, lateral clattering movement is eliminated by selecting the optimum position of the protuberance 46, when the engaging lug 36 of the tail plug 30 is engaged in the groove 47 in the knocking rod 40.

Further, the clattering of the knocking rod 40 is eliminated by making the level surface of the groove 47 higher than the surface of the circumferential section 43*a* and designing the engaging lug 36 so as to slightly contact the surface of the groove 47.

FIG. 9 shows a modification which provides visual confirmation of the locked condition and the unlocked condition of the knocking rod 40.

Figure 9C:
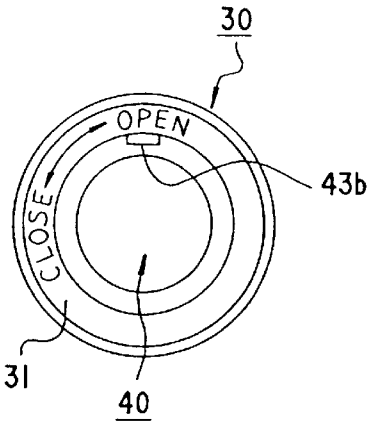
FIG. 9*a*–9*c* are front views of the knocking rod to explain the locking mechanism thereof.
Figure 9B:
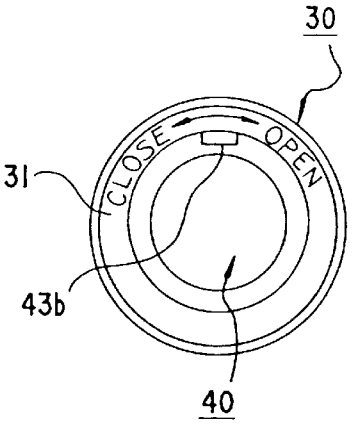
Figure 9A:
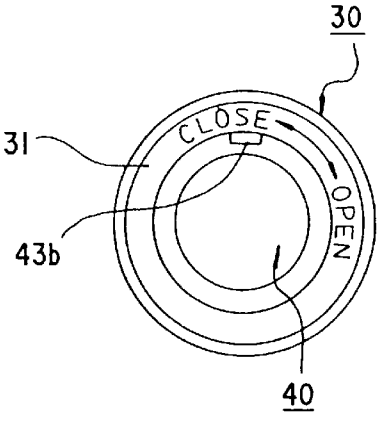
Figure 10:
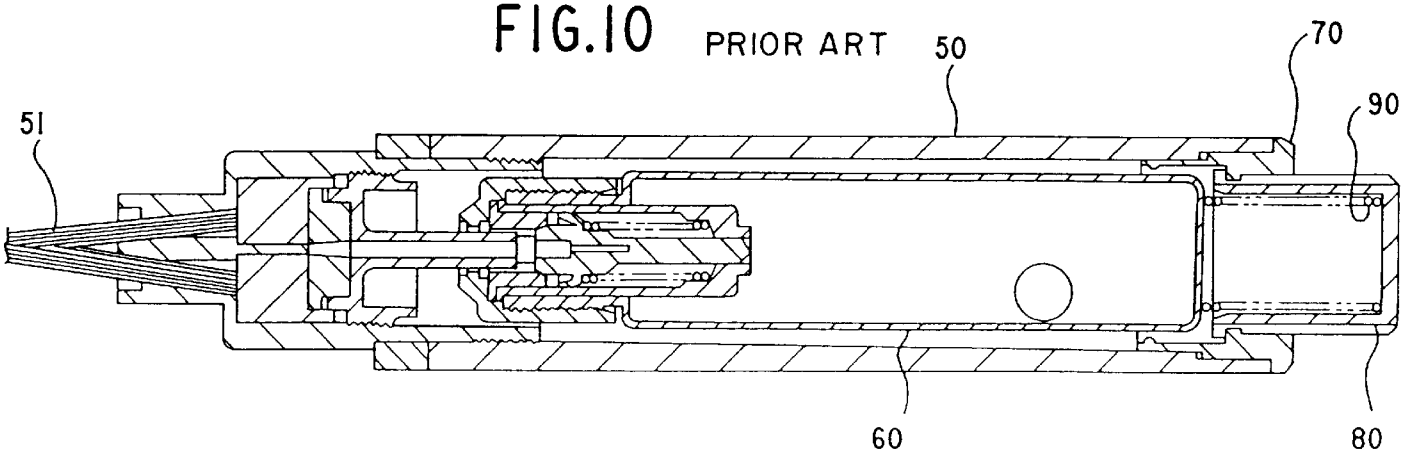
FIG.10 PRIOR ART
FIG. 10 is a centrally cut cross-sectional view of a prior art liquid applicator.
Figure 11:
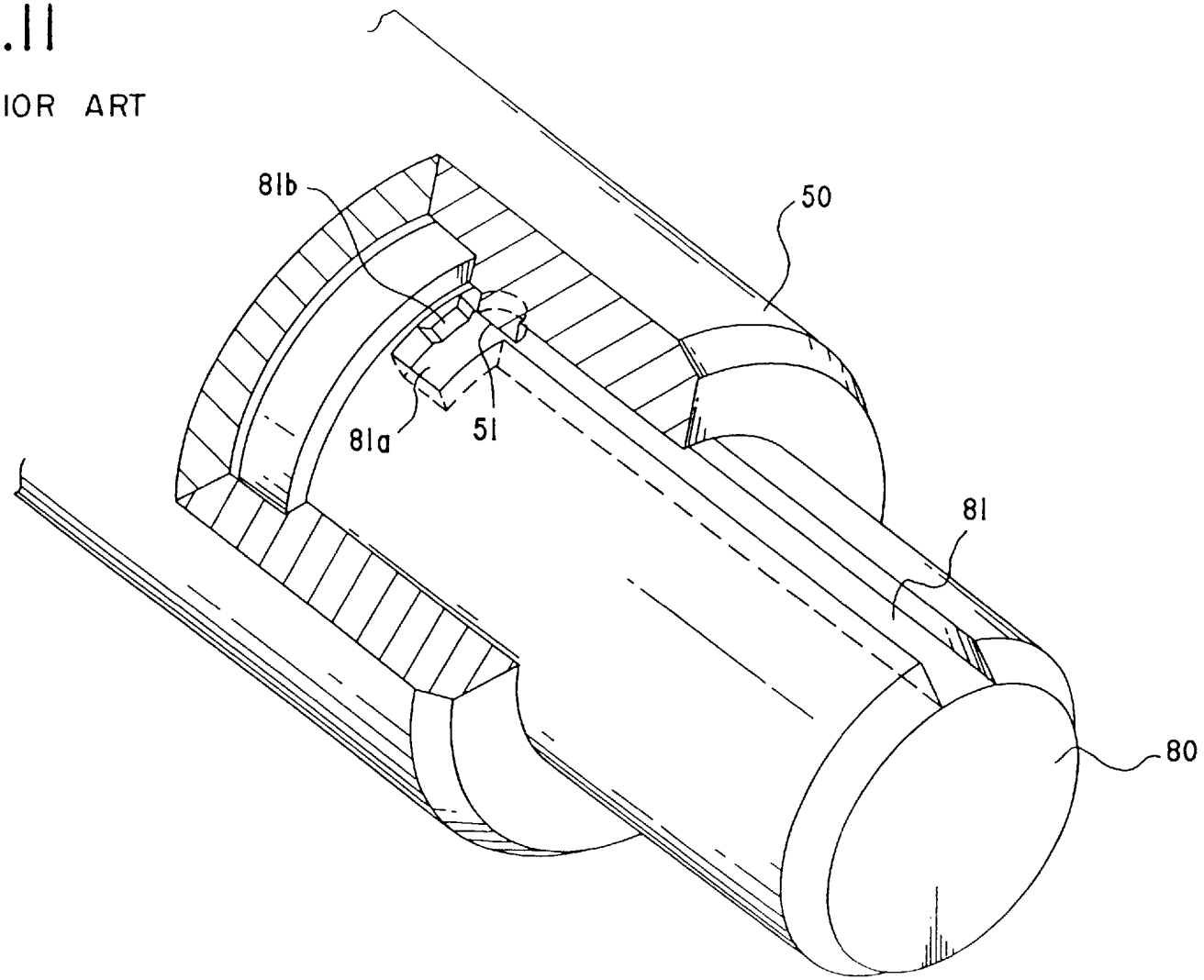
FIG. 11 PRIOR ART
FIG. 11 is a partial perspective view of another prior art liquid applicator.
Figure 12:
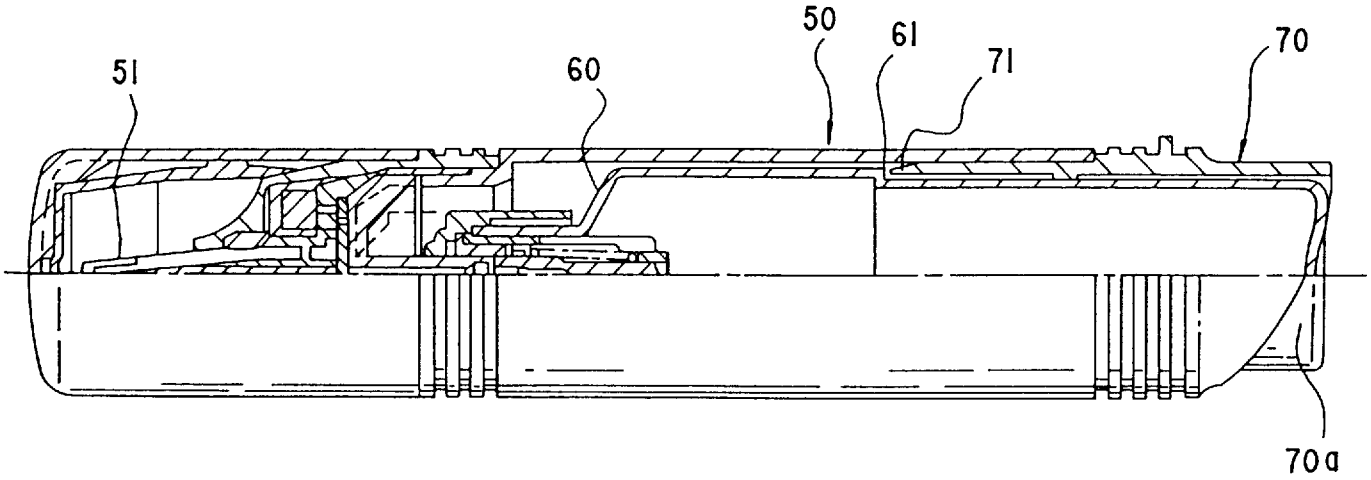
FIG.12 PRIOR ART
FIG. 12 is a partial longitudinal cross-sectional view of a further prior art liquid applicator.

Illustratively, FIGS. 9A through 9C show the rearward views of the liquid applicator, respectively, in which the indications "open" and "close" are provided with a two-arrow mark therebetween in the flange 31 of the tail plug 30 with the axial section 43*b* serving as a reference.

For instance, FIG. 9A shows that the reference by the axial section 43*b* is found at the "close" position to indicate that the knocking rod 40 is locked. FIG. 9B shows that the reference by the axial section 43*b* is intermediate to the "close" position and the "open" position. FIG. 9C shows that the reference by the axial section 43*b* is found at the "open" position to indicate that the knocking rod 40 is unlocked.

As explained in the foregoing, the cartridge-type liquid applicator of the present invention is constructed such that a cylindrical tail plug is detachably fitted into the rearward end of the applicator body with the engaging lug, formed into the tail plug to extend inwardly, being engaged into a L-shaped groove formed axially and circumferentially in the periphery of the knocking rod. As a result, the knocking rod is allowed to turn circumferentially to obtain a locking action to prevent the knocking rod from axially advancing.

Further, it is possible to take out the tank by removing the tail plug, fitted into the rearward end of the applicator body, with the result that it becomes possible to construct a simple spare cartridge-type liquid applicator which allows replacement of tanks.

Further, the cartridge-type liquid applicator of the present invention is constructed such that lugs or recesses are formed in the periphery of the cylindrical tail plug, while recesses or lugs are formed in the applicator in the area where the applicator body contacts the tail plug, with the cylindrical tail plug being formed with slits parallel to the axis thereof. As a result, the lug-recess engaging portions of both members are provided with mechanical elasticity to give an excellent feel at the time when the tail plug is attached to and removed from the applicator body.

Further, the cartridge-type liquid applicator of the invention is constructed such that an engaging protuberance projecting radially outwardly is formed in an area where the circumferential section adjoins the axial groove section with the result that an excellent clicking sound is obtained at the time of the locking operation of the locking rod.

Further, the cartridge-type liquid applicator of the invention is constructed such that a second protuberance is formed in the circumferential section at an intermediate area to extend radially outwardly. As a result, two clicking sounds are given at the time of the locking operation of the knocking rod to provide an additional sensory recognition of the lock.

Further, the cartridge-type liquid applicator of the invention is constructed such that a window is formed in the periphery of the knocking rod. As a result, it is possible to perspectively view the cartridge-type tank accommodated in the applicator body to assure the visual inspection for reading the remaining volume of the liquid inside the tank.

Further, the cartridge-type liquid applicator of the present invention is constructed such that each window is formed with a connecting piece to ensure that the cartridge tank facing the window will not be pressed by a finger even if the knocking rod is pulled out. As a result, any residual liquid in the cartridge tank will not be splashed around at the time of pulling out the knocking rod.

As detailed in the foregoing, the liquid applicator of the present invention eliminates the need for urging the knocking rod rearwardly by means of a coil spring as compared with the prior art structure and thus eliminates the need for firmly securing the tail plug to the applicator body. Therefore, it is possible to use a replaceable cartridge-type tank. In addition, it is possible to provide a locking mechanism with a simple construction in order to prevent an inadvertent pressing of the knocking rod. Further, it is possible to provide a cartridge-type liquid applicator which is capable of giving an excellent clicking sound at the time of performing the locking operation.

What is claimed is:

1. A cartridge-type liquid applicator of comprising:

a cylindrical applicator body having an inside surface and an opening at a rearward end of said cylindrical applicator body;

a liquid containing cartridge-type tank accommodated within said cylindrical applicator body;

a soaker body means, attached to said cylindrical applicator body at a forward end of said cylindrical applicator body, for applying said liquid in said cartridge-type tank;

a cylindrical tail plug detachably fitted to said inside surface of said cylindrical applicator body at said opening at said rearward end of said cylindrical applicator body, said cylindrical tail plug comprising:

a cylindrical body portion;

a flange portion integrally formed in an end portion of said body portion;

an inside through-hole having a flange side end opening and an opposite side end opening;

a first engagement means, comprising a guide portion and any one of a protrusion and a recess portion, for snap-on engagement;

a second engagement means formed at an area where said cylindrical applicator body contacts said cylindrical tail plug, wherein second engagement means is engagable with said first engagement means;

slits in a periphery of said cylindrical body portion, wherein said slits are formed so as to be parallel to an axis of said cylindrical tail plug, extending from said opposite side end opening to an intermediate portion of said cylindrical body portion; and an engaging lug in said inside through-hole surface of said cylindrical tail plug;

a knocking rod arranged within said cylindrical tail plug, wherein said knocking rod has an L-shaped groove formed at a periphery thereof, said L-shaped groove having a circumferential section and an axial section and said L-shaped groove being engagable with said engaging lug of said cylindrical tail plug for permitting a circumferential slide and an axial pressing action to lock said cylindrical tail plug and to force said liquid containing cartridge-type tank accommodated within said cylindrical applicator body forwardly through said cylindrical applicator body.

2. The cartridge-type applicator as set forth in claim 1, wherein said knocking rod is formed with an overridable protuberance protruding radially outwardly in said circumferential section of said L-shaped groove at an are adjoining said axial section of said L-shaped groove.

3. The cartridge-type applicator as set forth in claim 1, wherein said knocking rod is formed with a first overridable protuberance protruding radially outwardly in said circumferential section of said L-shaped groove at an area adjoining said axial section of said L-shaped groove and a second overridable protuberance protruding radially outwardly in an intermediate portion of said circumferential section of said L-shaped groove.

4. The cartridge-type applicator as set forth in claim 1, wherein said knocking rod is formed with a window in a periphery of said knocking rod at an area clear of said L-shaped groove to permit inspection of said carriage-type tank accommodated in said cylindrical applicator body.

5. The cartridge-type applicator as set forth in claim 1, wherein said knocking rod is formed with a window in a periphery of said knocking rod at an area clear of said L-shaped groove to permit inspection of said carriage-type tank accommodated in said applicator, said window being formed with a connecting piece to assure that said cartridge-type tank facing said window is prevented from being pressed by a finger.

* * * * *